US005220123A

United States Patent [19]

Oehry

[11] Patent Number: 5,220,123

[45] Date of Patent: Jun. 15, 1993

[54] EXPLOSIVE POWDER CHARGE OPERATED SETTING TOOL WITH MAGAZINE FOR FASTENING ELEMENTS

[75] Inventor: Norbert Oehry, Schaan, Liechtenstein

[73] Assignee: Hilti Aktiengesellschaft, Furstentum, Liechtenstein

[21] Appl. No.: 910,462

[22] Filed: Jul. 8, 1992

[30] Foreign Application Priority Data

Jul. 11, 1991 [DE] Fed. Rep. of Germany ..... 4122873

[51] Int. Cl.[5] ..... B25C 1/14

[52] U.S. Cl. ..... 89/1.14; 227/10

[58] Field of Search ..... 89/1.14; 227/9, 10, 227/11, 135

[56] References Cited

U.S. PATENT DOCUMENTS

| | | | |
|---|---|---|---|
| 3,863,824 | 2/1975 | Bakoledis | 277/10 |
| 4,051,990 | 10/1977 | Chromy et al. | 227/10 |
| 4,711,385 | 12/1987 | Jochum | 227/10 |
| 4,741,467 | 5/1988 | Gassner et al. | 227/10 |
| 4,930,673 | 6/1990 | Pfister | 227/10 |
| 4,932,580 | 6/1990 | Pfister | 227/10 |
| 5,136,921 | 8/1992 | Büchel | 89/1.14 |

*Primary Examiner*—David H. Brown

*Attorney, Agent, or Firm*—Anderson Kill Olick & Oshinsky

[57] ABSTRACT

An explosive powder charge operated setting tool includes a housing containing an axially extending fastening element guide which is axially displaceable opposite to the driving direction when the front end of the setting tool is pressed against a structural component into which a fastening element is to be driven. When it is axially displaced, the fastening element guide displaces a piston guide which, in turn, means a device into a cocked position so that a firing pin in the device is ready to ignite the powder charge. The fastening element guide has an axially extending feed slot aligned with a magazine forming a part of the housing. Fastening elements are connected together in a belt-like fashion by guide bushes each positioned on a fastening element. The feed slot has a stepped width extending in the axial direction so that in axial displacement of the fastening elements only a single fastening element can be positioned to be driven from the fastening element guide.

6 Claims, 2 Drawing Sheets

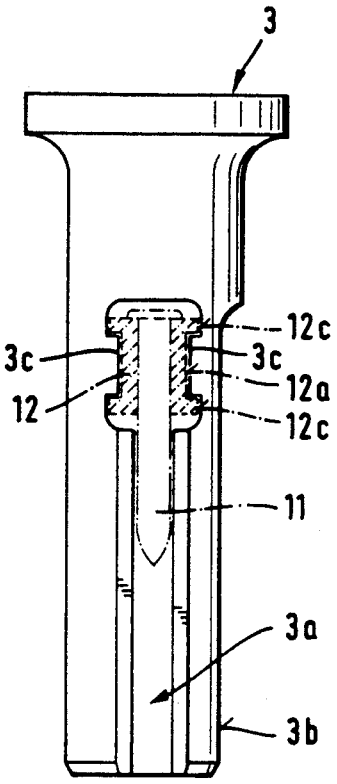
Fig. 4
Fig. 2
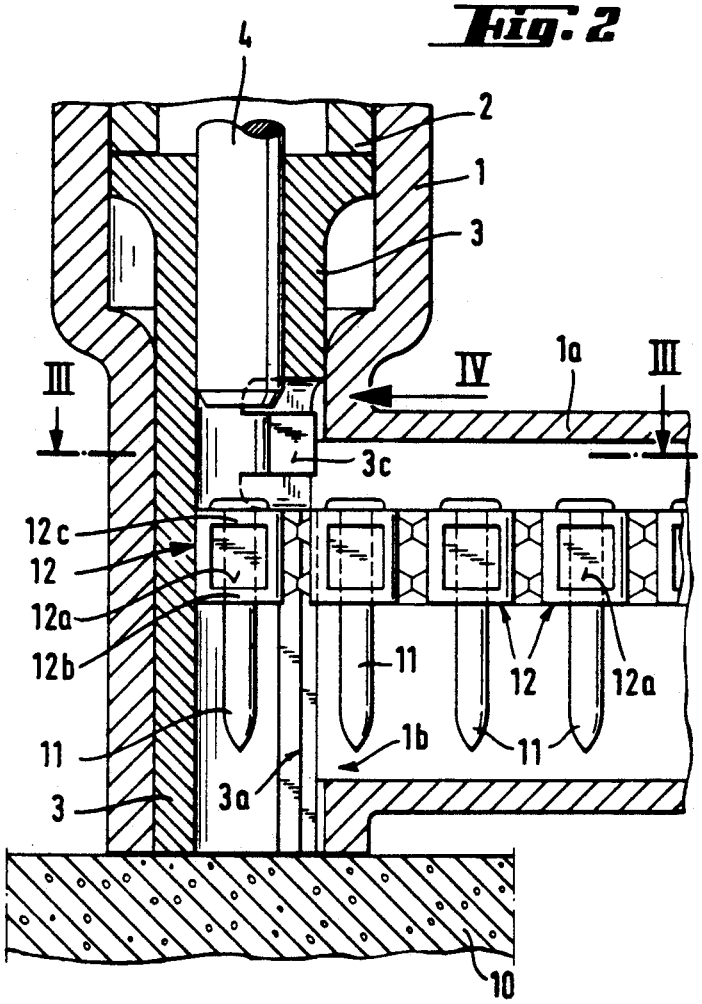
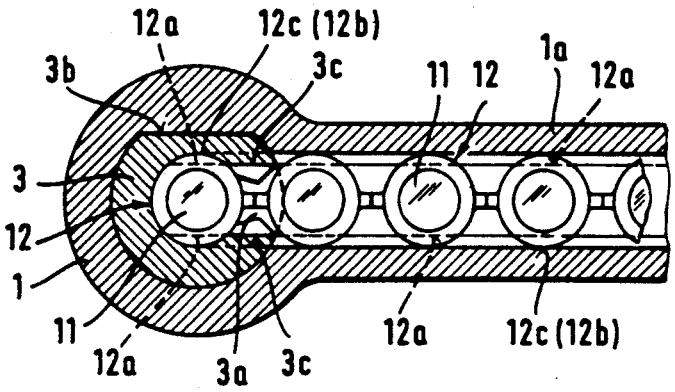
Fig. 3

EXPLOSIVE POWDER CHARGE OPERATED SETTING TOOL WITH MAGAZINE FOR FASTENING ELEMENTS

BACKGROUND OF THE INVENTION

The present invention is directed to an explosive powder charge operated setting tool having a housing including means located within and extending in the axial direction from the housing for effecting contact pressure with a structural component into which a fastening element is to be driven. A piston guide is located within the housing in contact with and behind the means so that both the means and the piston guide are axially displaceable when pressed against the structural component. Upon axial displacement of the means and the piston guide a device including a firing pin is displaced into the ready-to-fire position. The housing has a magazine extending transversely of the axial direction of the piston guide and aligned with a passage in the housing, so that fastening elements in the magazine each secured in a guide member and connected together in a belt-like manner can be inserted into the setting tool.

An explosive powder charge operated setting tool with a transversely extending magazine for fastening element secured in guide bushes connected in a belt-like manner is known from DE-A-36 06 514. In this known setting tool containing the magazine the same problem that existed in individually fired tools must be solved, that is, the tool can be placed in the operating condition for firing explosive powder charges only if the tool is pressed against a structural component into which the fastening elements are to be driven. This feature is the only way for avoiding accidents that could result in injuring personnel.

To assure this operational feature the known setting tools have a firing mechanism for the explosive powder charges and it is placed in the cocked or ready-to-fire position only if the setting tool is pressed against a structural component. Accordingly, a device for placing the firing pin in the ready-to-fire position is provided cooperating with the axially displaceable piston guide. The piston guide is displaceable within the housing containing the magazine. The housing can be constructed in several parts to achieve additional operational features.

An axially displaceable contact pressure probe cooperates with the axially displaceable piston guide and projects beyond the front end face of the setting tool when it is not pressed against a structural component. When the setting tool is pressed against a structural component, the contact pressure probe is displaced rearwardly in the housing opposite to the setting direction and a similar displacement of the piston guide is effected and the placement of the firing pin in the ready-to-fire position is achieved. In the ready-to-fire position, the setting tool is ready to operate by igniting the explosive powder charge. As a result, the above-mentioned setting tool satisfies the requirements for security or safety in connection with pressing the setting tool against the structural component. The security feature regarding feeding the fastener element into the guide is not completely assured. Since the housing has an opening or through-passage for introducing the fastening elements from the transversely extending magazine into the housing and has a constant inside projection in the various positions of the setting tool, there is the danger, because of the feeding mechanism for the fastening elements, that the elements are driven to such an extent into the housing that the next following fastening element is in a position to be contacted by the driving piston. While the fastening element to be driven is in proper position, the next following fastening element is located in the housing in such a position that it tends to cause an operational malfunction. In an extreme case this next following fastening element can form a passage for itself and exit from the setting tool, causing destruction of parts of the housing wall or of the magazine.

SUMMARY OF THE INVENTION

Therefore, the primary object of the present invention is to proved an explosive powder charge operated setting tool capable of satisfying all safety requirements whereby an explosive powder charge can be ignited only if the setting tool is pressed against a structural component, while assuring that the driving piston acts only the fastening element intended to be driven into the structural component.

In accordance with the present invention, the axially displaceable means is shaped as a fastening element guide in axial alignment with the driving piston and including a feed slot for the passage of individual fastening elements along with the associated guide member into a fastening element guide. As distinguished from the conventional solution, where the front or leading end of the housing acts as the fastening element drive, in the present invention a fastening element guide separate from the housing is provided. This arrangement affords a precise placement of the fastening elements along with their guide bushes serving as retainers or mounts, into the fastening element guide. Accordingly, it is assured that the fastening element is adequately guided during the entire driving operation and the driving piston acts only on the fastening element intended to be driven into the structural component.

Due to the axial displaceability of the fastening element guide, the feed slot can, if appropriately designed, assume a quasi slider function, that is, the inside cross-section of the feed slot can be arranged so that the insertion of the fastening elements with the guide bushes is possible only in one specific position. Accordingly, the width of the feed slot in the entry region of the guide bushes corresponds expediently to the shape of the guide bushes in the feed direction with the remaining region of the feed slot having a width for accepting the diameter of the parts of the fastening element projecting from the guide bushes. As a result, the feed slot is arranged to accept the length of the guide bushes and also the remaining parts of the fastening elements extending from the guide bushes. Thus the feed slot is stepped in its width and has its maximum width in the trailing end region of the slot where the guide bushes are mounted on the fastening elements.

If guide bushes, as known from DE-A-36 06 901, are used for the fastening elements, that is, guide bushes with guide regions having a circular cross-section located on the opposite ends of an axial section, then the region of the feed slot with the larger width is correspondingly stepped. Accordingly, the stepped region of the feed slot with a smaller width forms larger width shoulders, so that the axial section of the guide bushes between the wider shoulders guide the fastening elements and assure that they do not twist or turn. Preventing twisting or turning is of particular advantage when the last fastening element is to be fed or if only a few fastening elements remain connected to one another in a belt-like manner.

The above-mentioned slider feature, produced by the axial displaceability of the fastening element guide, can act in a twofold way with appropriate length selection of the individual regions.

In one operating condition it is assured, when the setting tool is pressed against the structural component, that the end region of the feed slot with the smaller width located at the trailing end is at least partially pushed over the guide bush forming stops in the feed direction of the fastening elements whereby any feed movement of the following fastening element is prevented and perfect guidance conditions are formed during the driving operation. With this design of the feed slot, the feed mechanism magazine always inserts a single fastening element into the fastening element guide when the tool is not pressed against a structural component.

In one embodiment when the setting tool is not pressed against the structural component, the entry region of the feed slot for receiving the guide bushings is axially offset in the driving direction, so that the feed mechanism in the magazine cannot drive a fastening element into the fastening element guide. The feed slot is dimensioned in such a way, so that only after a portion of the axial travel to the contact pressure of the fastening element guide with the structural component does the entry region of the feed slot for the guide bushes move into alignment with the guide bushes, whereby a fastening element can enter into the fastening element guide. As a result, when the setting tool is not pressed against a structural component, there is no fastening element located in the guide, and a fastening element can enter the fastening element guide only shortly prior to the displacement of the fastening element guide and piston guide into the ready-to-fire position, that is, after traveling for a portion of the axial movement resulting from the contact pressure of the fastening element guide with the structural component. In operation, the following fastening element is moved into position and perfect guide conditions are provided for the inserted fastening element during the entire driving process.

For adequately assuring feed of a fastening element into the fastening element guide, an axial length of the feed slot corresponds at least to the axial length of the fastening elements. Preferably, the feed slot is open at the front end of the fastening element guide, so that an adequate length is afforded and a simple economic manufacture of the fastening element guide is assured.

To make sure that the guide slot is properly aligned with the through opening in the housing, whereby the entry of the fastening element into the guide is not blocked, the fastening element guide is shaped to prevent twisting or turning. The prevention of turning is assured in a simple way by providing the fastening element guide with an axially extending flat surface on its outside surface which cooperates with a matching flat surface within the housing and the flat surface of the housing can be provided in the form of a separate detachable part.

The various features of novelty which characterize the invention are pointed out with particularity in the claims annexed to and forming a part of this disclosure. For a better understanding of the invention, its operating advantages and specific objects attained by its use, reference should be had to the drawing and descriptive matter in which there is illustrated and described a preferred embodiment of the invention.

BRIEF DESCRIPTION OF THE DRAWING

In the drawing:

FIG. 2 is an enlarged partial view of the setting tool in FIG. 1 where the tool is pressed against a structural component and is in the ready-to-fire position;

FIG. 3 is a sectional view taken along the line III—III in FIG. 2; and

FIG. 4 is an elevational view of the fastening element guide corresponding to the position shown by the arrow IV in FIG. 2 in the fastening element charging position with the fastening element shown in dot-dash lines.

DETAILED DESCRIPTION OF THE INVENTION

Figure 1:
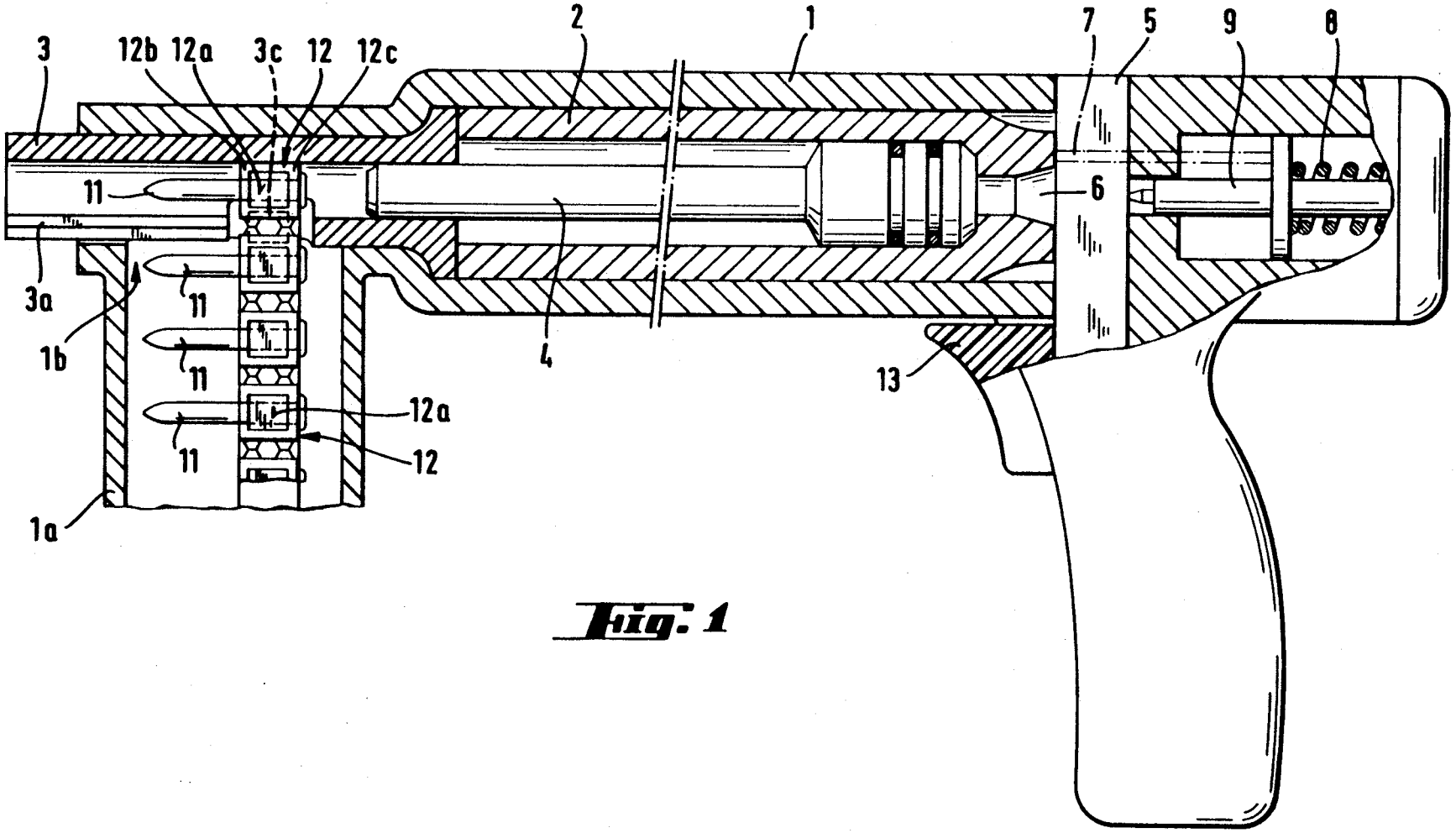
FIG. 1 is a side elevational view, partially in section, of a setting tool embodying the present invention and illustrated in a neutral and charging position.

In FIGS. 1 to 3, and particularly in FIG. 1, the setting tool embodying the present invention comprises a housing 1 having a front end from which a fastening element is driven and a rear end. An axially extending piston guide 2 is located within the housing axially aligned with and in contact with a rear end of a fastening element guide 3. The piston guide 2 and the fastening element guide 3 are axially displaceable as a unit within the housing 1. A driving piston 4 is axially displaceable within the piston guide 2 and the fastening element guide 3. The front end of the driving piston 4 is supported within the fastening element guide 3 and its enlarged rear end is located within the piston guide 2. The driving piston 4 is driven by an explosive powder charge not shown in the drawing and the charge can be fed to a cartridge chamber 6 in the rear end of the piston guide from a magazine, not shown, into a channel 5 extending transversely of the axial direction of the housing 1. The explosive powder charges are fed into the cartridge chamber due to a rearward axial displacement of the piston guide 2 via the channel 5 and such displacement occurs when the setting tool is pressed against a structural component 10, such as shown in FIG. 2 When the setting tool is pressed against the structural component 10, the fastening element guide 3 is pressed opposite to the firing direction into the housing 1 and pushes the piston guide rearwardly. During such rearward motion a pin 7, shown in dot-dash lines in FIG. 1, presses a device 8 into a ready-to-fire position in which the firing pin 9 is ready to ignite an explosive powder charge. As a result, the setting tool is in the ready-to-fire position as shown in FIG. 2.

Adjacent its front end, the housing 1 has a magazine 1*a* extending outwardly transversely of the axial direction of the housing. Magazine 1*a* holds the fastening elements 11 each in a guide bush 12 with the bushes connected to one another in a belt-like manner. The guide bushes have a much smaller axial length than the fastening elements and are located at the trailing ends of the elements. The guide bushes 12 have axially spaced circular guide sections 12*b*, 12*c* on the opposite ends of an axially extending mid-section 12*a*. The fastening elements 11 along with the guide bushes 12 are fed one at a time by a feeding mechanism, not shown in the drawing, into the fastening element guide 3. In the embodiment shown in FIG. 1, the fastening elements 11 and the guide bushes 12 arrive, one at a time, in the fastening element guide 3 when the setting tool is not pressed against the structural component 10. If in the ready-to-fire position of the setting tool pressed against the structural component 10 as shown in FIG. 2, the device 8 is released by a trigger 13, the firing pin 9 strikes the propellant powder charge inserted into the cartridge chamber 6, not shown in the drawing, whereby the explosive gas generated by the ignition of the powder charge accelerates the driving piston in the driving direction, that is toward the front end of the housing. As the driving piston 4 is driven by the explosive gases, the fastening element 11 is driven into the structural component 10 and its guide bush 12 is sheared off from the guide bush on the next following fastening element. The sheared-off guide bush 12 serves as a guide for the fastening element 11 within the fastening element guide 3 during the entire driving operation.

As displayed in FIGS. 1 to 3, a through opening 1*b* adjacent the front end of the housing 1 is aligned with a magazine 1*a*, so that the fastening elements 11 along with the guide bushes 12 can be fed, one at a time, into the fastening element guide 3. Fastening element guide 3 has an axially extending feed slot 3*a* for introducing the fastening elements 11 along with the guide bushes 12 into the fastening element guide. The feed slot 3*a*, as shown best in FIG. 4, has a stepped width. The width of the slot 3*a* is greater at the rear end of the slot and is shaped to accept the shaped configuration of the guide bushes 12. The axial length of the stepped section corresponds essentially to the axial length of the guide bushes and the slot is configured so that shoulders 3*c* are formed. The width between the shoulders 3*c* is slightly greater than the corresponding width of the axially extending section 12*a* located between the circular guide sections 12*b*, 12*c*. The width of the remaining length of the feed slot 3*a* extending to the front end of the fastening element guide 3 corresponds at least to the diameter of the fastening elements extending forwardly from the guide bushes.

As can be seen best in FIG. 3, the stepped width of the feed slot 3*a* is such that in the ready-to-fire position with the fastening element guide 3 displaced so that its front end is flush with the front end of the setting tool pressed against the structural component, at least an axially extending part of the feed slot is displaced rearwardly from the inserted fastening element 11. As a result, a lock is formed whereby the following fastening element 11 cannot enter the fastening element guide 3 even though it is pressed in that direction by the feed mechanism. The position of the fastening element 11 and its guide bush 12 relative to the feed slot 3*a* is displayed in FIG. 2.

To assure that the feed slot 3*a* and the through opening 1*b* remain in alignment with one another, the fastening element is prevented from turning or twisting by an axially extending flat surface 3*b* on its outer surface cooperating with a similar flat surface on the inside surface of the housing 1, as illustrated in FIG. 3. In FIG. 3 additional details of the feed slot 3*a* are shown, and the details include that the feed slot 3*a*, in the axial mid-sections 12*a* of smaller width, taper at the free ends, so that during axial displacement of the fastening element guide 3 opposite to the driving direction there is no interference caused by the guide bushes 12.

While a specific embodiment of the invention has been shown and described in detail to illustrate the application of the inventive principles, it will be understood that the invention may be embodied otherwise without departing from such principles.

I claim:

1. Explosive powder charge operated setting tool comprises a housing having a front end from which fastening elements can be driven and a rear end and an axial direction extending in the front end—rear end direction, means located within and extending in the axial direction of said housing, said means projecting from the front end of said housing, an axially extending piston guide located within said housing aligned with and rearwardly of said means, said piston guide has a front end in contact with said means, an axially extending driving piston having a front end located within said means and a rear end located within said piston guide, said means and piston guide are axially displaceable from a first position with said means projecting from said housing rearwardly to a second position located closer to the rear end of said housing, said means and piston guide are axially displaceable from the first position to the second position when said means are pressed against a surface to receive a fastening element, a device for cocking a firing pin is placed in a ready-to-fire position when said means and piston guide are moved into the second position, an opening in said housing in an axially extending region of said means, a magazine extending transversely of the axial direction of the housing and aligned with the opening in said housing, said magazine arranged to hold fastening elements to be inserted from said magazine into the setting tool in position to be driven from the tool, a guide bush arranged on each of said fastening elements and said guide bushes connected together in a belt-like manner, wherein the improvement comprises that said means comprises an axially extending fastening element guide in axial alignment with said piston guide and driving piston, and said fastening element guide has an axially extending feed slot so that individual said fastening elements and guide bushes can be inserted from said magazine into said fastening element guide.

2. Explosive powder charge operated setting tool, as set forth in claim 1, wherein said feed slot has a first width in the axial length thereof arranged to receive the guide bushes and corresponds substantially to the configuration of the guide bushes in the axial direction and a second width in the axial direction of the remainder of said feed slot corresponds at least to the diameter of the fastening elements extending axially from said guide bushes.

3. Explosive powder charge operated setting tool, as set forth in claims 1 or 2, wherein the axial length of said feed slot corresponds at least to the axial length of said fastening elements.

4. Explosive powder charge operated setting tool, as set forth in claim 3, wherein said fastening element guide has a front end arranged to project from said housing, and said feed slot is open at the front end of said fastening element guide.

5. Explosive powder charge operated setting tool, as set forth in claim 4, wherein said fastening element guide includes means for preventing said fastening element guide from turning relative to the axial direction.

6. Explosive powder charge operated setting tool, as set forth in claim 5, wherein said means for preventing turning of said fastening element guide comprises an axially extending flat surface on the outside surface of said fastening element guide and a cooperating flat surface on an inside surface of said housing.

* * * * *